US009316001B2

(12) United States Patent
King

(10) Patent No.: US 9,316,001 B2
(45) Date of Patent: Apr. 19, 2016

(54) ROOF DRAINAGE SYSTEM

(71) Applicant: FORTICRETE LIMITED, Leicestershier (GB)

(72) Inventor: Phillip Mark King, Witney (GB)

(73) Assignee: FORTICRETE LIMITED, Leicestershire (GB)

( * ) Notice: Subject to any disclaimer, the term of this patent is extended or adjusted under 35 U.S.C. 154(b) by 0 days.

(21) Appl. No.: 14/647,036

(22) PCT Filed: Nov. 22, 2013

(86) PCT No.: PCT/GB2013/053085
§ 371 (c)(1),
(2) Date: May 22, 2015

(87) PCT Pub. No.: WO2014/080213
PCT Pub. Date: May 30, 2014

(65) Prior Publication Data

US 2015/0275522 A1 Oct. 1, 2015

(30) Foreign Application Priority Data

Nov. 22, 2012 (GB) ..... 1221030.8

(51) Int. Cl.
*E04D 13/04* (2006.01)
*E04D 13/147* (2006.01)
*E04D 13/03* (2006.01)

(52) U.S. Cl.
CPC ..... *E04D 13/0477* (2013.01); *E04D 13/03* (2013.01); *E04D 13/0404* (2013.01); *E04D 13/0481* (2013.01); *E04D 13/147* (2013.01);
(Continued)

(58) Field of Classification Search
CPC ..... E04D 13/03; E04D 13/04; E04D 13/0481; E04D 13/1475; E04D 13/0315; E04D 13/147; E04D 2013/045; E04D 2013/0486; E04D 13/0404; E04D 13/0477
USPC ..... 52/58, 60, 97, 200
See application file for complete search history.

(56) References Cited

U.S. PATENT DOCUMENTS 1,792,704 A * 2/1931 Peverley ..... 52/209
2,875,710 A * 3/1959 Bechtold ..... 52/72
4,559,753 A * 12/1985 Brueske ..... 52/748.1
(Continued)

FOREIGN PATENT DOCUMENTS

DE 200 15 228 U1 11/2000
EP 2607569 A1 * 6/2013
(Continued)

OTHER PUBLICATIONS

PCT International Search Report and the Written Opinion of the International Searching Authority Mailed Mar. 18, 2014 PCT/GB2013/053085.
(Continued)

*Primary Examiner* — Robert Canfield
(74) *Attorney, Agent, or Firm* — Howard & Howard Attorneys PLLC

(57) ABSTRACT

A pitched roof structure including a plurality of roof tiles and a roof aperture in the roof tiles and accommodating a roof component, such as a rooflight, characterised in that precipitation leaking from the vicinity of the roof aperture is directed away from the aperture and under the roof tiles to the roof eave.

8 Claims, 7 Drawing Sheets

(52) U.S. Cl.
CPC .... *E04D 13/1475* (2013.01); *E04D 2013/0486* (2013.01)

(56) References Cited

U.S. PATENT DOCUMENTS

| | | | | | |
|---|---|---|---|---|---|
| 4,730,426 | A | * | 3/1988 | Weisner et al. | 52/200 |
| 4,750,302 | A | * | 6/1988 | Bechtold | 52/72 |
| 4,776,141 | A | * | 10/1988 | Powell | 52/200 |
| 5,053,266 | A | * | 10/1991 | Hesketh et al. | 428/192 |
| 5,094,040 | A | | 3/1992 | Bunka | |
| 5,675,940 | A | * | 10/1997 | Bahar et al. | 52/58 |
| D391,648 | S | * | 3/1998 | Sølbeck | D25/60 |
| 5,806,255 | A | * | 9/1998 | Verby et al. | 52/200 |
| 6,052,956 | A | * | 4/2000 | Hoy et al. | 52/200 |
| 6,151,838 | A | * | 11/2000 | Husein | 52/58 |
| 6,212,834 | B1 | * | 4/2001 | Lindgren | 52/200 |
| 6,263,624 | B1 | | 7/2001 | Hoy et al. | |
| 6,354,046 | B1 | * | 3/2002 | Swearingen | 52/97 |
| D489,834 | S | * | 5/2004 | Weston | D25/199 |
| 6,951,081 | B2 | * | 10/2005 | Bonshor | 52/97 |
| 7,040,061 | B2 | * | 5/2006 | Rillie et al. | 52/200 |
| 7,168,211 | B2 | * | 1/2007 | Prenn et al. | 52/200 |
| 7,308,777 | B2 | * | 12/2007 | Sandow | 52/200 |
| 7,712,279 | B2 | * | 5/2010 | McClure | 52/580 |
| 8,205,401 | B2 | * | 6/2012 | Ward | 52/198 |
| 2003/0150175 | A1 | * | 8/2003 | Rillie | 52/200 |
| 2006/0070315 | A1 | * | 4/2006 | McClure | 52/200 |
| 2006/0230694 | A1 | * | 10/2006 | Skov et al. | 52/200 |
| 2007/0101665 | A1 | * | 5/2007 | Sandow | 52/200 |
| 2015/0096246 | A1 | * | 4/2015 | Chan | 52/203 |
| 2015/0121773 | A1 | * | 5/2015 | Mills et al. | 52/58 |

FOREIGN PATENT DOCUMENTS

| | | | | |
|---|---|---|---|---|
| GB | 2 180 566 | A | | 4/1987 |
| GB | 2 454 709 | A | | 5/2009 |
| GB | 2521456 | A | * | 6/2015 |
| JP | H10 266486 | A | | 10/1998 |
| WO | 2015092402 | A1 | * | 6/2015 |

OTHER PUBLICATIONS

The International Search Report and the Written Opinion (PCT/GB2013/053085); Date of Mailing: Mar. 18, 2014.

* cited by examiner

ROOF DRAINAGE SYSTEM

The present invention relates to a drainage system for a pitched roof structure that includes a roof aperture accommodating a roof component such as a rooflight. The invention encompasses a pitched roof structure including the drainage system, a drainage panel for use in the drainage system, and a method of draining such a roof structure.

BACKGROUND TO THE INVENTION

The primary function of a roof structure is to protect a lower space below the roof structure from external elements such as wind and precipitation. A typical pitched roof structure includes a plurality of parallel load-bearing rafters that slope from a ridge at the top of the roof structure to an eave at a lowermost edge of the roof structure, and a plurality of parallel battens disposed on top of, and extending orthogonally with respect to, the rafters. A pitch angle of the roof structure is defined between the rafters and a horizontal plane that includes the eave.

Roof covering elements such as tiles are affixed along the battens in horizontally-extending rows or courses. Each course of tiles underlaps the course of tiles directly above and overlaps the course of tiles directly below, such that the tiles overlap in a ridge-to-eave direction. The tiles of the roof structure act as a primary drainage system. Precipitation that falls on the roof structure flows down the tiles towards the eave and into a gutter arranged beneath and parallel to the eave. The gutter then carries the precipitation away from the roof structure.

The tiles typically incorporate certain design features to prevent precipitation penetrating between the tiles. For example, within a course of tiles, the left-to-right neighbouring tiles may be arranged to interlock with one another to guard against water penetration between neighbouring tiles of a course. Between the courses, upper and lower neighbouring tiles may be provided with weather checks that guard against ingress of upwardly wind-driven rain. An example of such tiles is described in the Applicant's granted patent GB2454709, in which the weather checks are ridges disposed on the undersurface of a tile, that, in a tiled roof, rest on the upper surface of a tile in the course below. The weather checks guard against ingress of precipitation by increasing the tortuosity of the upward path of precipitation. This is particularly important in low-pitched roof structures, which term is understood in the art to mean roof structures having a pitch between approximately 10° and approximately 15°.

Roof structures often include additional roof components that are accommodated on or in, or that extend through, the roof structure. For example, components such as windows (known in the art as rooflights), vents, sun pipes, fire escapes or false chimneys may be incorporated. Such roof components require an aperture in the tiles of the roof structure, so as to allow light, air or the roof component to pass through the tiles.

When such components are incorporated into roof structures, it is important that measures are taken to guard against precipitation leaking into the space beneath the roof structure, for example via gaps between the roof component and the surrounding tiles. In particular, precipitation is prone to leak between the roof component and the course of tiles that extends directly below the roof component (referred to hereafter as the lower bordering course).

It is known, therefore, to provide flashing that supplements the primary drainage system of the tiles to resist penetration of precipitation. For example, the aperture may be encircled by a frame that is surrounded by flashing that extends from the frame a short distance up, down and across the roof to surround the frame. Above and to the sides of the aperture, the flashing lies above the battens and below the tiles. Beneath the aperture, a lower portion of the flashing extends downwardly and is raised over an uppermost edge of the lower bordering course, such that the flashing is brought onto an upper surface of the tiles of that course. The lower portion of the flashing therefore incorporates a distinct upward step that brings the lower portion from a position below the tiles to a position above the tiles.

In use, the flashing catches precipitation that falls between the aperture and the surrounding tiles. That precipitation flows downwardly from the area surrounding the aperture onto the lower portion of the flashing. As the precipitation flows down the lower portion, it is guided over the step at the uppermost edge of the lower bordering course, and hence is guided onto the upper surface of the tiles of that course. The precipitation then flows down the upper surface of those and subsequent lower tiles in the usual way.

There are significant disadvantages associated with such known flashing systems, which limit their effectiveness in preventing leakage of precipitation, especially in low-pitched roof structures.

Firstly, to raise the lower portion of the flashing over the lower bordering course, the lower portion must be brought between the tiles of the lower bordering course, and the overlapping tiles of the course above. In this way, the flashing lifts the upper course of tiles away from the tiles of the lower bordering course, firstly creating an undesirable gap between the courses and secondly disrupting contact between the weather check of the upper tile and the surface of the lower tile. The gap and the disruption to the weather checks allow ingress of upwardly wind-driven rain between the courses, resulting in leakage.

Secondly, at the sides of the aperture the flashing disrupts the tiles of the roof structure. The flashing covers the battens, so that the tiles cannot be fixed to the battens in the vicinity of the aperture; however the tiles must lie as close as possible to the aperture in the interest of preventing leakage. These conflicting requirements mean that tiles must be cut precisely to size so as to be fixed in place around the aperture, and there is little room for error. An improper job in cutting and laying the tiles, for example by a rushed or negligent tiler, frequently leads to problematic leakage around the aperture. Furthermore, if the tiles are profiled (i.e. having an undulating surface) the tiles may need to be cut at different points on the profile, leaving gaps of varying depth beneath the tiles, further hindering fixing and sealing of the tiles.

Such flashings are still more problematic when used in low-pitched roof structures. Where the flashing steps upwardly over the uppermost edge of the lower bordering course, a horizontal trough is defined in the flashing. Precipitation and debris can collect in the trough, preventing effective drainage. This problem can be mitigated to some extent by trimming the top edge of the tiles immediately below the rooflight to reduce the depth of the trough. However, this process is time consuming and detrimental to the function of the tile because it effectively reduces the overlap of the tiles, and it does not, in any case, avoid the problem altogether.

SUMMARY OF THE INVENTION

From a first aspect, the invention resides in a pitched roof structure including a plurality of roof tiles and a roof aperture in the roof tiles and accommodating a roof component, such as a rooflight, characterised in that precipitation leaking from the vicinity of the roof aperture is directed away from the aperture and under the roof tiles to the roof eave.

By directing precipitation away from the aperture and under the roof tiles to the roof eave, the invention provides a pitched roof structure in which precipitation is efficiently and effectively drained away from the aperture, reducing the tendency of the roof structure to leak in the vicinity of the roof component. Directing the precipitation under the tiles means that disruption to the tiles is substantially avoided, further reducing the tendency to leak.

In one embodiment of the invention, the leaking precipitation in the pitched roof structure is directed by means of a drainage panel extending under the roof tiles from the roof aperture to the eave.

The drainage panel provides a particularly simple and yet effective means of directing precipitation under the tiles by restricting the path of the draining precipitation to within the drainage panel.

Preferably, the drainage panel is disposed between the roof rafters and tile-supporting battens extending transversely to, and fixed to the rafters. In this way, the battens can extend across the drainage panel and up to the aperture without disruption. The tiles can be secured to the battens in usual way, with the battens providing full support to the tiles. This allows the tiles to be easily fitted around the aperture, without the need to accommodate shortened or otherwise disrupted battens.

Optionally, the drainage panel may have an upper face provided with at least one run-off channel for directing the leaking precipitation from the roof aperture to the eave. The run-off channel provides a clear path for draining precipitation, which further increases the efficiency of the drainage of precipitation from the aperture to eave In one embodiment, the at least one run-off channel is defined by parallel ridges projecting from the upper face of the drainage panel. The parallel ridges guide the precipitation directly down the drainage panel from the aperture to the eave, and hence increase the efficiency of the drainage panel still further. The parallel ridges are also a simple and cost-effective means for providing the run-off channel.

Preferably, the ridges raise the battens above the upper face of the drainage panel. Raising the battens above the upper face of the drainage panel keeps the run-off channels clear, so that precipitation can flow easily down the drainage panel. Advantageously, raising the battens also removes the battens from the path of the draining precipitation, reducing undesirable exposure of the battens to precipitation.

In one embodiment, further ridges are disposed at an angle to the parallel ridges and project from the drainage panel above the aperture to deflect leaking precipitation away from the aperture and into the run-off channels. Disposing deflecting ridges above the aperture in this way prevents precipitation and debris collecting above the roof component.

Preferably, the drainage panel has a lower end portion at the eave, and the eave fascia board has a recess that receives the lower end portion of the drainage panel. In this way, the drainage panel is able to extend beyond the fascia board and out of the roof structure, such that draining precipitation can exit the roof structure.

In a preferred embodiment, the drainage panel surrounds and hangs from a frame of the roof aperture to hold the drainage panel in position beneath the roof tiles. Hanging the drainage panel from a frame in this way allows the drainage panel to be held in place without the need for fixing elements. This reduces the cost and complexity of installing the drainage panel, and avoids the need for fixing elements that might otherwise penetrate the drainage panel, compromising its ability to reduce the tendency for leakage.

In another embodiment, the drainage panel has a drainage panel portion adjacent the roof aperture, and at least one extension portion incorporating the lower end portion of the drainage panel. Incorporating one or more extension portions in this way allows the drainage panel to adapt to roof structures of different sizes.

To ease manufacture of the drainage panel still further, the drainage panel may be of unitary construction and made of a metal such as aluminium or of a plastics material.

The invention also resides in a drainage panel for a tiled roof structure, which structure accommodates a roof component such as a rooflight, the panel comprising: an under-tile base having run-off elements defining a run-off direction extending between opposed peripheral edges of the base; an aperture for the roof component disposed at a position offset along the run-off direction closer to one of those opposed edges of the base; and one or more run-off channels defined by the run-off elements and extending between the aperture and the other of the opposed edges of the base.

Such a drainage panel provides a particularly simple and yet effective means of directing precipitation under within a roof structure by restricting the path of draining precipitation. The offset of the aperture allows the drainage panel to extend down the roof structure to an eave of the structure, and the run-off channel extending between the aperture and the other of the opposed edges of the base allows precipitation to be drained continuously to the eave via the run-off channels.

The invention also extends to a drainage panel for use in a pitched roof structure as previously described.

The invention further resides in a method of draining precipitation leaking from the vicinity of an aperture in a pitched roof structure, the method including draining the precipitation by directing it away from the aperture and under roof tiles of the structure to an eave of the structure.

By directing precipitation away from the aperture and under the roof tiles to the roof eave, the invention provides a drainage method in which precipitation is efficiently and effectively drained away from the aperture, reducing the tendency of the roof structure to leak in the vicinity of the roof component.

BRIEF DESCRIPTION OF THE DRAWINGS

Embodiments of the present invention will now be described, by way of example only, with reference to the accompanying drawings, in which like reference numerals refer to like parts, and in which.

Figure 1:
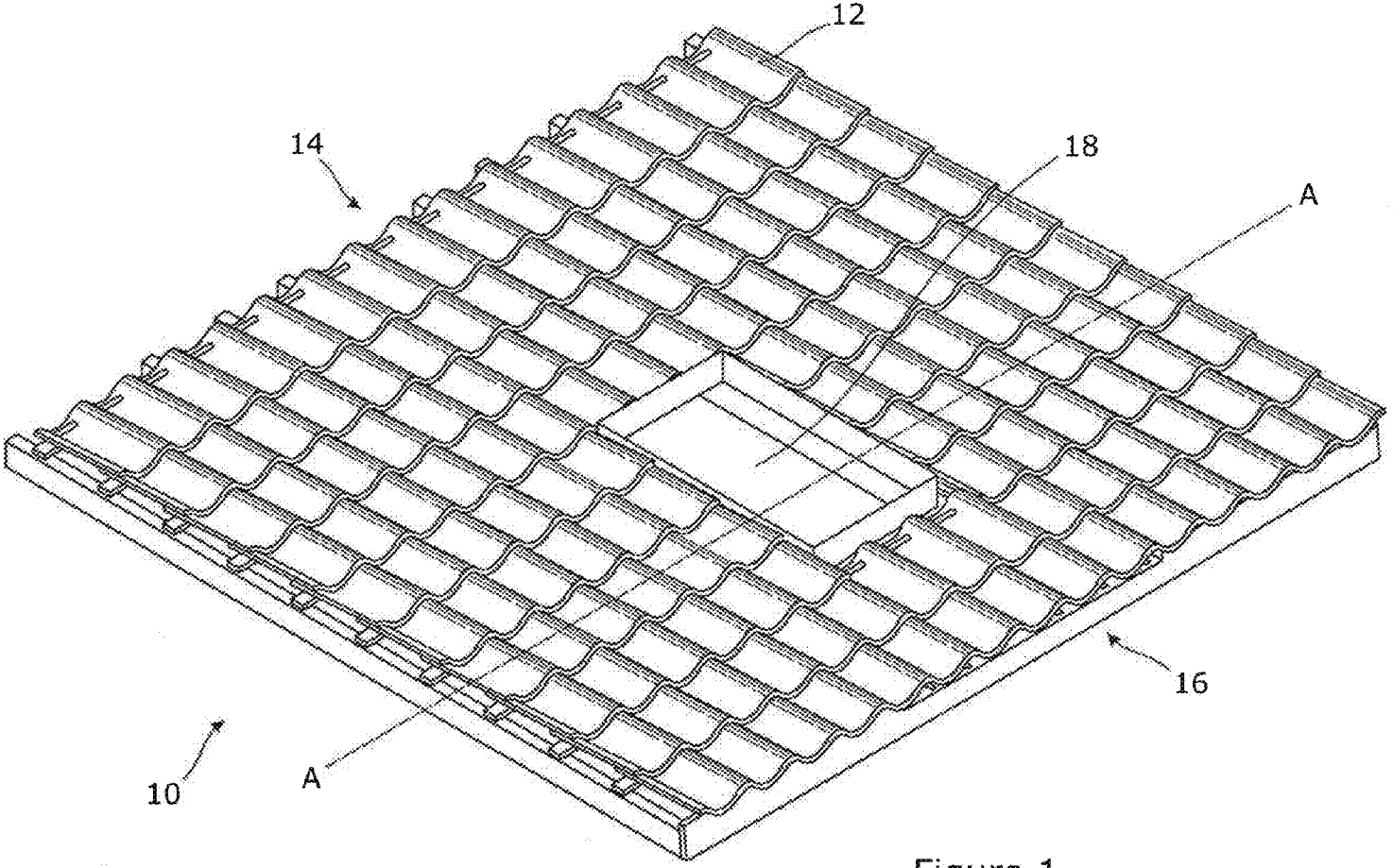
FIG. 1 is a perspective view of a tiled pitched roof structure according to an embodiment of the invention.
Figure 2:
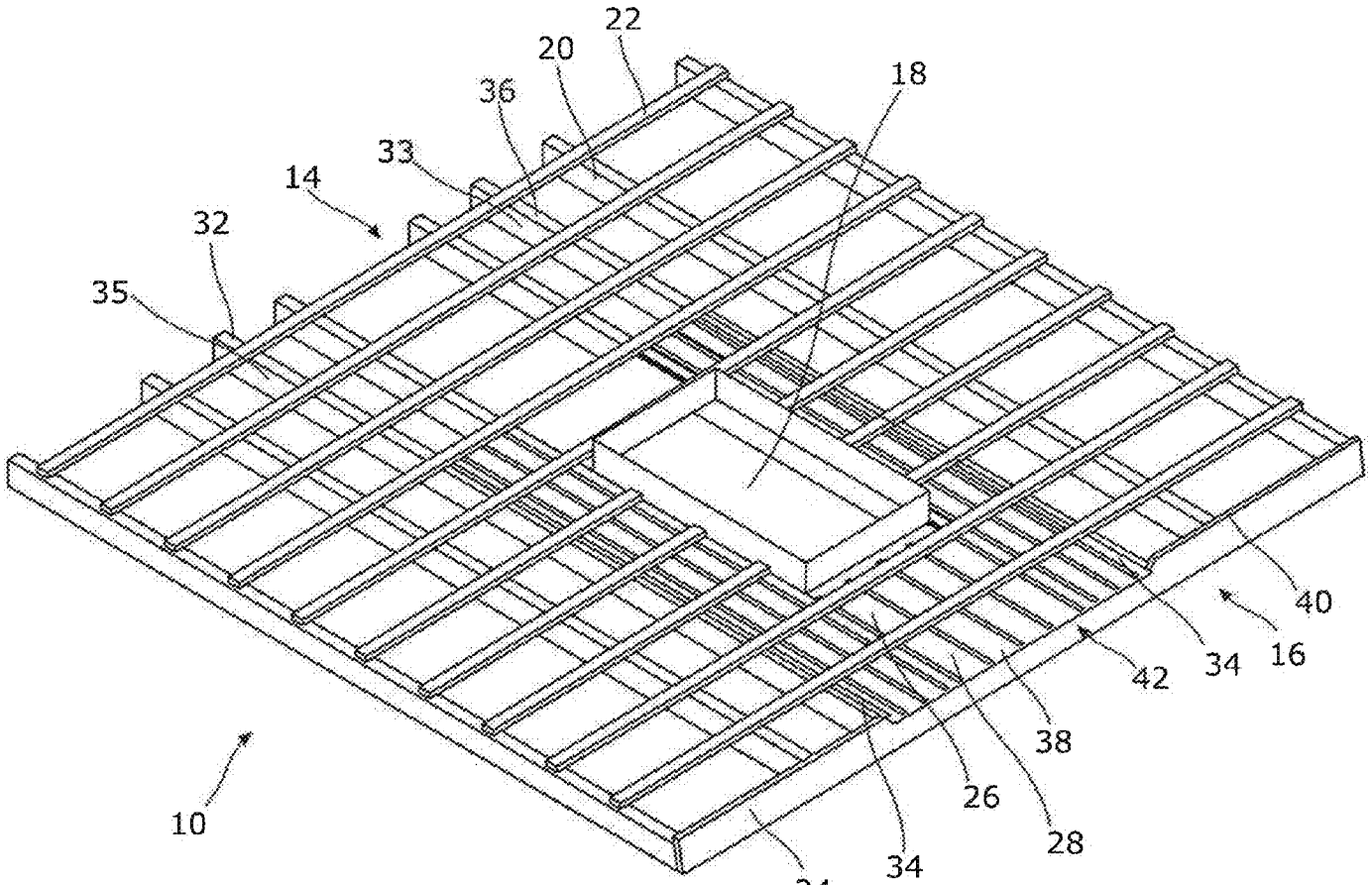
FIG. 2 is a perspective view of the roof structure of FIG. 1 with its tiles removed.
Figure 3:
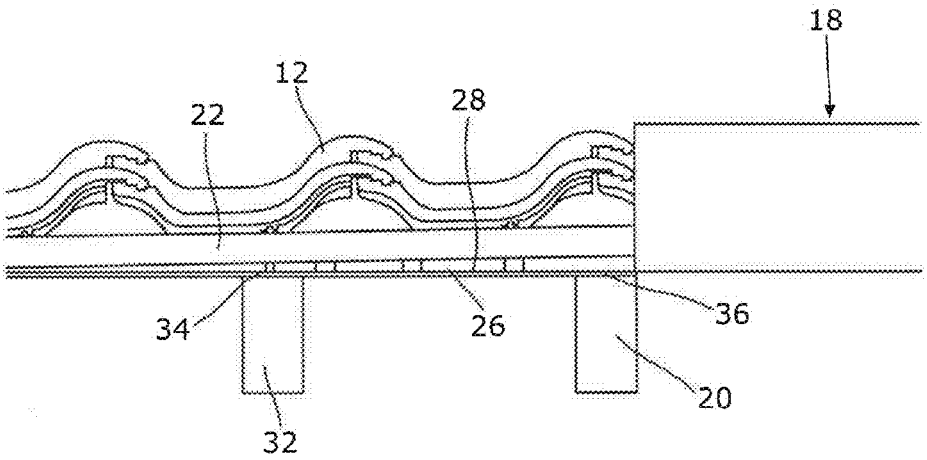
FIG. 3 is a partial cross-sectional view of the roof structure of FIG. 1 along the line A-A of FIG. 1.

Throughout this specification, terms such as 'upper' and 'lower' are used with reference to the orientation of a roof structure, and to the orientation of a drainage panel assembled in situ within such a roof structure, as shown in FIGS. 1 to 3 of the accompanying drawings.

DETAILED DESCRIPTION OF EMBODIMENTS OF THE INVENTION

FIG. 1 illustrates a pitched roof structure 10 having a plurality of tiles 12 exemplifying roof covering elements, which may alternatively be, for example, slates. The tiles 12 extend from an upper edge 14 of the roof structure, described here as a ridge, but which may alternatively be a top abutment, to an eave 16 at a lower edge of the roof structure 10.

A roof aperture 18 is provided in the roof structure 10, so as to define an opening extending through the roof structure 10. The roof aperture 18 is surrounded by a frame (not shown), and accommodates a roof component (not shown), which, in the embodiments described below, is exemplified as a rooflight.

FIG. 2 illustrates the components of the roof structure 10 that lie beneath the tiles 12. It will be apparent that the roof structure 10 also includes a plurality of parallel rafters 20 that extend down the roof structure 10 to the eave 16, and a plurality of parallel tile battens 22 extending above and orthogonally with respect to the rafters 20. A roof underlay (not shown) extends across the roof structure 10 and is provided between the rafters 20 and the battens 22. A fascia board 24 extends along the eave 16.

In accordance with the invention, a drainage panel 26 is disposed between the rafters 20 and the battens 22 which extends around the roof aperture 18, and from the roof aperture 18 down to the eave 16.

The rooflight is supported and held in alignment with the roof aperture 18 by the rafters 20 that neighbour the roof aperture 18. The rooflight is attached to the rafters 20 by suitable fixings, such as brackets, which also serve to transfer the load of the rooflight to the rafters 20.

The roof aperture 18 is surrounded by the drainage panel 26 which extends outwardly from the roof aperture 18 up, down and across the roof structure 10 to surround the roof aperture 18. In all directions, the drainage panel 26 is disposed between the rafters 20 and the battens 22, such that the drainage panel 26 extends under the roof tiles 12, as will be evident in FIGS. 2 and 3. Said another way, an upper face 28 of the drainage panel 26 faces the battens 22 and a lower face 30 of the drainage panel 26, visible in FIGS. 6 and 7, faces the rafters 20. Below and to the sides of the aperture 18, the drainage panel 26 is disposed above the underlay. Above the aperture 18, a portion of the underlay overlaps the drainage panel 26.

Above and to the sides of the roof aperture 18, the drainage panel 26 extends a short distance away from the aperture 18. Below the roof aperture 18, the drainage panel 26 extends continuously from the roof aperture 18 to the eave 16.

The drainage panel 26 is supported in the roof structure 10 by supplementary rafters 32, which are disposed at, and aligned with, respective side edges 34 of the drainage panel 26. Inner sides 33 of the supplementary rafters 32 are spaced apart by a distance that is slightly less than the width of the drainage panel 26. In this way, the side edges 34 of the drainage panel 26 can be supported by, and fixed to, respective supplementary rafters 32. Nevertheless, the spacing between outer sides 35 of the supplementary rafters 32 is greater than the width of the drainage panel 26, such that part of an upper surface 36 of the rafters 20 remains uncovered by the drainage panel 26, for attachment of the battens 22.

At the eave 16, a lower end portion 38 of the drainage panel 26 extends a short distance beyond the fascia board 24. As shown in FIG. 2, the fascia board 24 has an upper edge 40 that is provided with a recess 42 aligned with the drainage panel 26. The recess 42 allows the fascia board 24 to receive the lower end portion 38. A gutter (not shown) is provided beneath the lower end portion 38 to receive precipitation from the tiles 12 and the drainage panel 26.

Referring now to FIGS. 4 to 7, which show the drainage panel 26 in isolation for convenience, the drainage panel 26 includes a base 44 in the form of a substantially flat, rectangular sheet. The sheet 44 is rigid or semi-rigid, and self-supporting, such that it maintains its substantially flat configuration without external support.

The sheet 44 is provided with ridges 46 aligned in a generally ridge-to-eave direction that extend down the length of the drainage panel 26. Run-off channels 48 are defined between the ridges 46, which also extend down the length of the drainage panel 26. In this way, the ridges 46 and run-off channels 48 define a run-off direction, down which precipitation is directed when the drainage panel 26 is in use.

A rectangular panel aperture 50 is provided in the sheet 44. The panel aperture 50 is offset in the run-off direction, such that the panel aperture 50 is closer to an upper end 52 of the drainage panel 26 than a lower end 38 of the drainage panel 26. As shown in FIG. 2, the panel aperture 50 is aligned with the roof aperture 18, and is dimensioned to accommodate the rectangular rooflight and the frame that surrounds it. Thus, the panel aperture 50 is of slightly larger dimensions than the frame surrounding the rooflight.

Figure 4:
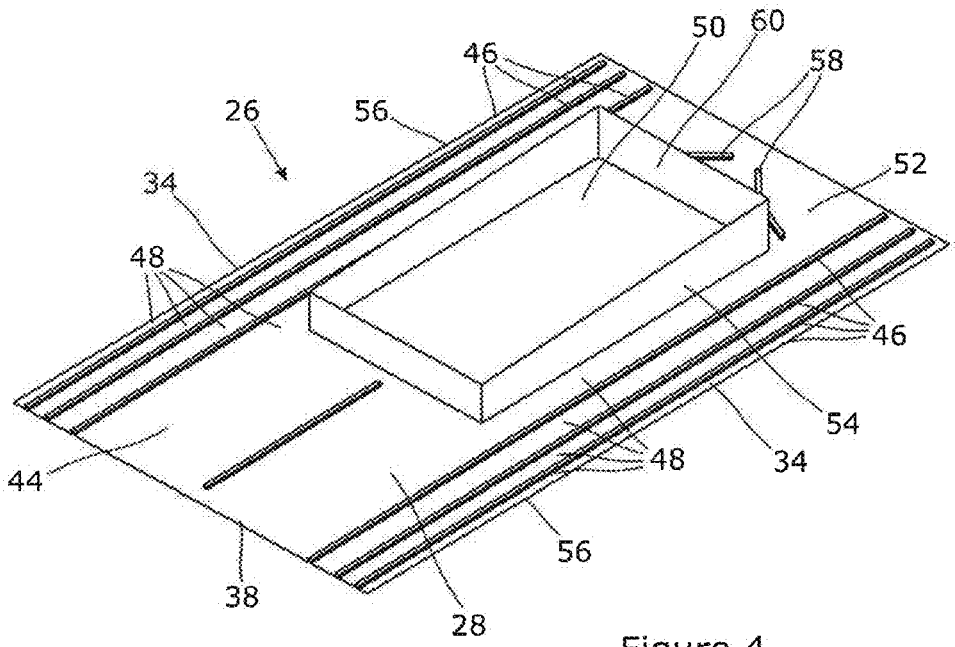
FIG. 4 is a perspective view of the drainage panel of FIG. 1.
Figure 6:
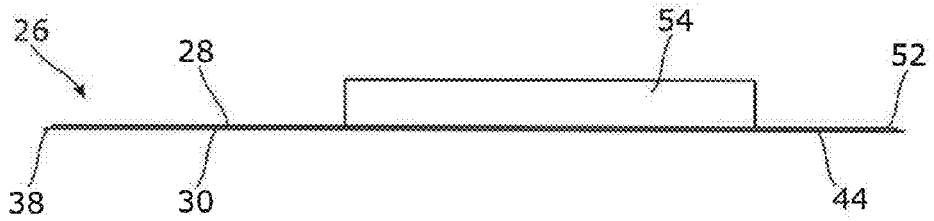
FIG. 6 is a side view of the drainage panel of FIG. 4.

As best seen in FIGS. 4 and 6, a rectangular frame 54 also surrounds the panel aperture 50. The frame 54 includes four projecting walls that extend orthogonally away from the upper face 28 of the drainage panel 26. In the assembled roof structure 10, the frame 54 of the drainage panel 26 surrounds and is sealed to the frame surrounding the rooflight, for example by means of a cover flashing. In this way, the drainage panel 26 hangs from the frame surrounding the rooflight, so as to be held in place between the rafters 20 and the battens 22 without the need for fixings that would otherwise perforate the drainage panel 26.

Figure 5:
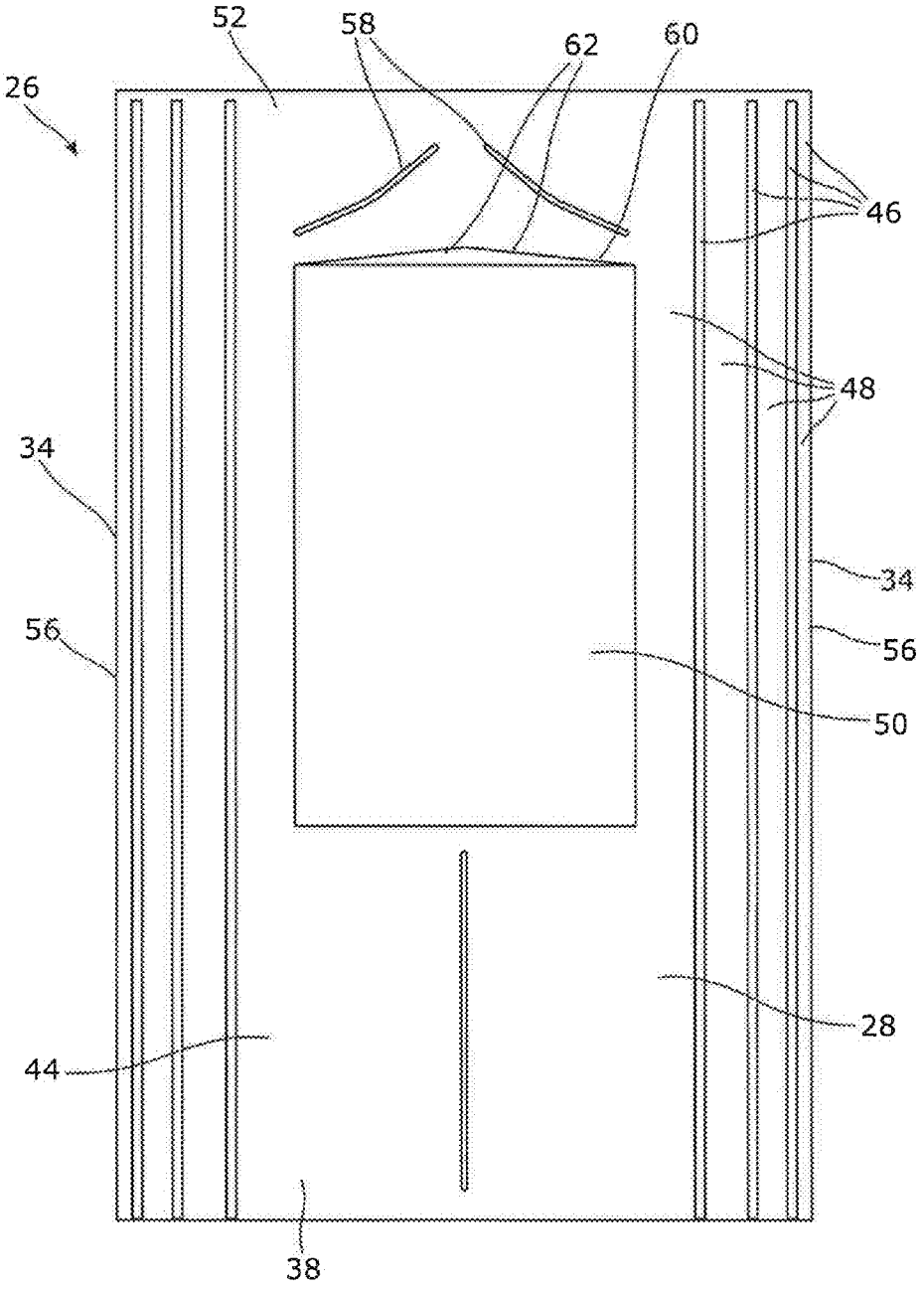
FIG. 5 is a plan view of the drainage panel of FIG. 4.

Referring to FIGS. 4 and 5, parallel ridges 46 project from the upper face 28 of the drainage panel 26. The parallel ridges 46 are disposed at the sides of the panel aperture 50, and below the panel aperture 50. The function of the ridges 46 is two-fold. Firstly, the ridges 46 define run-off channels 48 that direct precipitation down the drainage panel 26. Secondly, the ridges 46 act as platforms that raise the battens 22 of the roof structure 10 above the upper face 28 of the drainage panel 26.

It will be appreciated that the run-off channels 48 must be capable of holding a sufficiently large volume of precipitation, so as to avoid over-spill into the roof structure 10. However, to reduce the displacement of the battens 22 as they pass over the drainage panel 26, it is desirable to minimise the depths of the run-off channels 48. These conflicting requirements can be accommodated by arranging the ridges 46 as will now be described.

Figure 7:
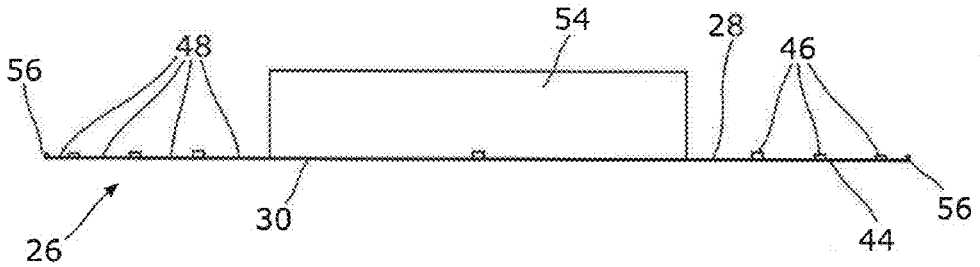
FIG. 7 is an end view of the drainage panel of FIG. 4.

Each ridge 46 is of constant height above the upper face 28. However, as best shown in FIG. 7, the ridges 46 differ in height. Specifically, the heights of the ridges 46 decrease in the outward direction, such that a ridge 46 closest to the panel aperture 50 is the highest and a ridge 46 closest to an outer edge 34 of the drainage panel 26 is the lowest. The heights of the ridges 46 determine the depths of the run-off channels 48, and the run-off channels 48 therefore decrease in depth moving from the panel aperture 26 to the outer edge 34 of the drainage panel 26.

As best seen in FIG. 5, at the sides of the panel aperture 50, the horizontal spacing between the ridges 46 varies such that the ridges 46 are spaced closer together moving from the panel aperture 50 to the outer edge 34 of the drainage panel 26. In this way, the run-off channels 48 defined between the parallel ridges 46 decrease in width moving from the panel aperture 50 to the outer edge of the drainage panel 26.

The depth and width of each run-off channel 48 determines the volume of precipitation that the run-off channel 48 can accommodate. In use, the deeper and wider run-off channels 48 closest to the panel aperture 50 receive the largest volume of precipitation, while the shallower and narrower run-off channels 48 closest to the panel edges 34 receive the smallest volume of precipitation. Thus, each run-off channel 48 is only of the width and depth that is necessary to receive the expected amount of precipitation.

As best illustrated in FIG. 3, when the battens 22 are arranged over the ridges 46, the optimisation of the run-off channels 48, and in particular the stepped ridge heights, gradually raise the battens 22 away from the upper face 28 of the drainage panel 26 providing run-off channels 48 beneath the battens 22. In this way, disruption to the battens 22 across the drainage panel 26 caused by deflection is minimised.

As best shown in FIG. 7, outermost ridges 56 are provided at the outermost sides 34 of the drainage panel 26, and are thinner than the remaining ridges 46. These ridges 46 provide a lip that extends down the length of the drainage panel 26 to provide a barrier that prevents precipitation flowing off the sides of the drainage panel 26 when in use.

Above the panel aperture 50, deflecting ridges 58 are provided on the upper face 28 of the drainage panel 26. These deflecting ridges 58 are disposed at an angle to the parallel ridges 46, and act to deflect precipitation and debris around the roof component, and to provide additional support for the battens 22. Also above the aperture 50, the upper wall 60 of the frame 54 includes sloping walls 62 that direct precipitation outwardly and downwardly.

In use, when precipitation falls between the rooflight and the surrounding tiles 12, the seal between the frame and the rooflight means that the precipitation cannot penetrate between the rooflight and the drainage panel 26. Instead, this precipitation is caught by the upper face 28 of the drainage panel 26 and is directed downwardly via the run-off channels 48, under the tiles 12, to the eave 16. At the eave 16, the precipitation is drained into the gutter and carried away from the roof structure 10.

Precipitation that is caught by the drainage panel 26 above the roof aperture 18 is deflected around the aperture 18 by the deflecting ridges 58. This guards against precipitation pooling above the rooflight, and also reduces the tendency for debris to become trapped above the rooflight, causing blockages.

The majority of the precipitation received by the drainage panel 26 is precipitation that falls between the tiles 12 and the rooflight. Thus, the majority of the precipitation received by the drainage panel 26 is received by the run-off channels 48 that are closest to the panel aperture 50. It will be appreciated that the relatively large volume of precipitation received by these run-off channels 48 can easily be accommodated by their relatively large width and height.

The drainage panel 26 therefore provides an efficient means for draining precipitation away from a roof aperture 18 by providing a sub-tile drainage path that extends down to the eave 16 of the roof structure 10, below the battens 22. The drainage panel 26 avoids the need for undesirable flashing extending between adjacent courses of tiles as is necessary in the prior art, thereby substantially avoiding disruption to the tiles 12, and the associated pooling and leakage.

Figure 8:
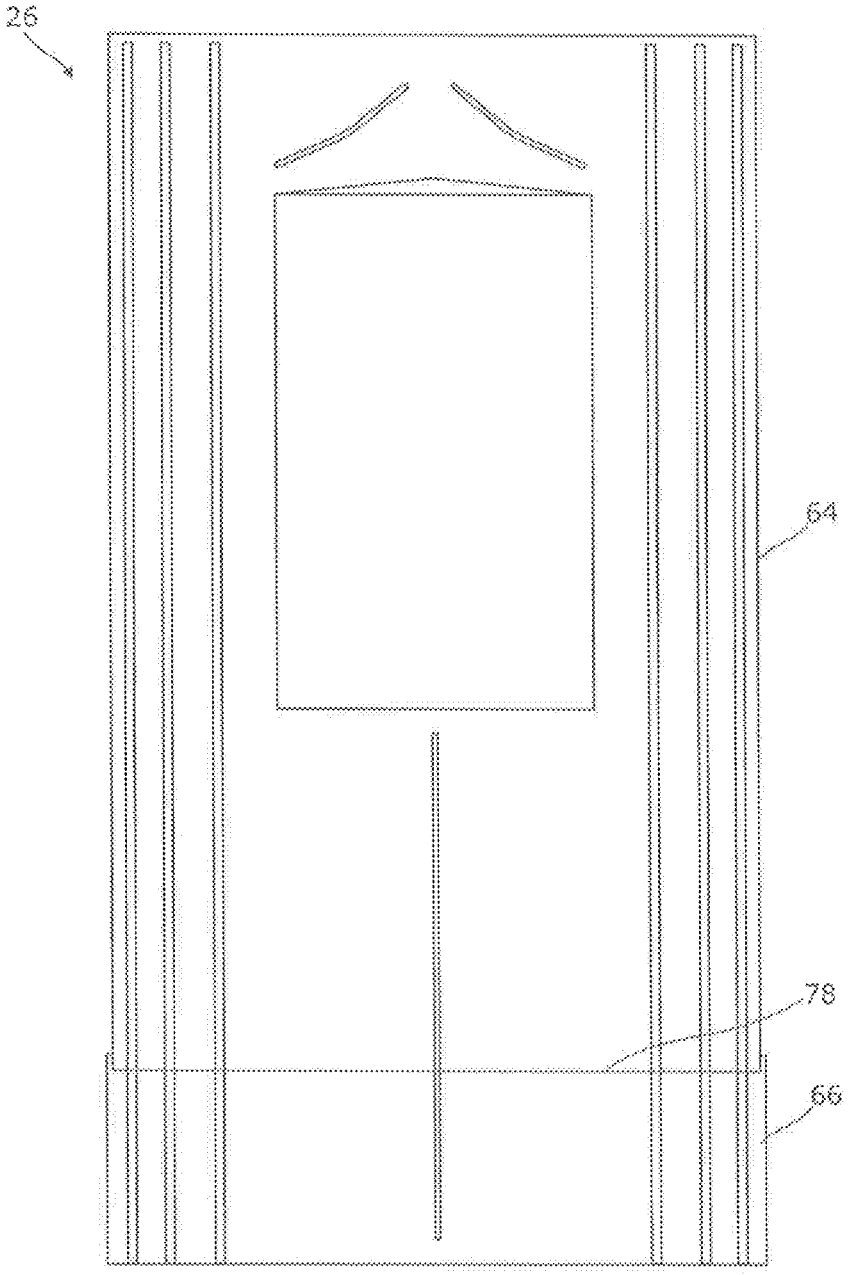
FIG. 8 is a plan view of a drainage panel including an extension portion according to an alternative embodiment of the invention.

If the drainage panel 26 is intended for use in a roof structure 10 that is particularly large, the drainage panel 26 described above may not be of sufficient length to extend from the roof aperture 18 to the eave 16. Accordingly, an alternative embodiment of the invention is illustrated in FIG. 8, in which like reference numerals correspond to like parts. In this embodiment, the drainage panel described as above serves as a drainage panel portion or upper portion 64 of the drainage panel 26, the drainage panel 26 further comprising one or more extension portions 66. The lowermost extension portion 66 incorporates the lower end 38 of the drainage panel 26. In this way, the desired number of extension portions 66 are arranged beneath the drainage panel portion 64 to extend the drainage panel 26 from the roof aperture 18 to the eave 16.

Figure 9:
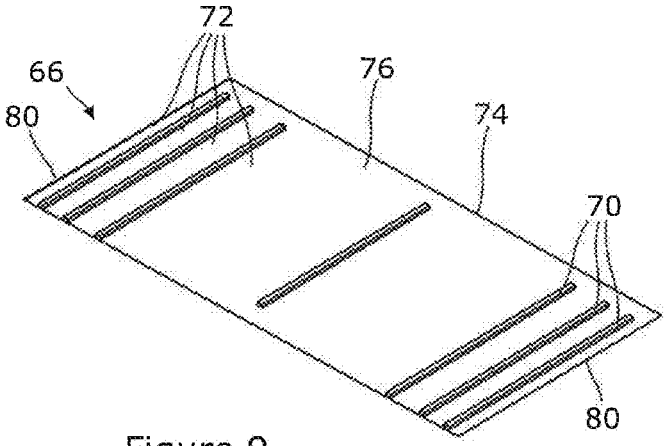
FIG. 9 is a perspective view of the extension portion of FIG. 8.
Figure 10:
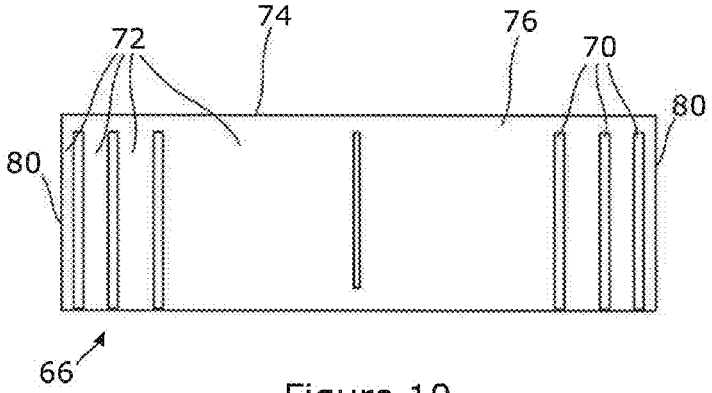
FIG. 10 is a plan view of the extension portion of FIG. 8.
Figure 11:
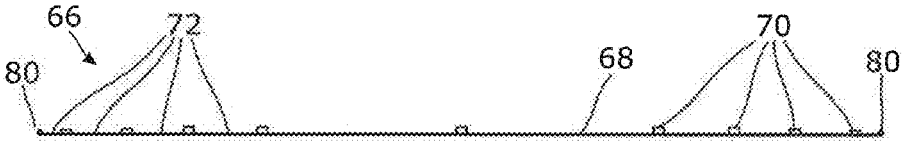
FIG. 11 is an end view of the extension portion of FIG. 8.

Referring to FIGS. 9 to 11, the extension portion 66 includes an upper face 68 provided with ridges 70 that define run-off channels 72. The ridges 70 are of substantially the same form and arrangement as those on the upper portion 64, being of the same height and width as corresponding ridges 46 on the upper portion 64 and being spaced apart by corresponding distances. In this way, when the upper portion 64 and extension portion 66 are arranged together to form the drainage panel 26, the ridges 46 on the upper portion 64 align with the ridges 70 on the extension portion 66, thereby providing continuous ridges 46, 70 and run-off channels 48, 72 that extend the length of the drainage panel 26.

At an upper edge 74 of the extension portion 66, the ridges 70 are truncated to provide a clearance region 76 between the ridges 70 and the upper edge 74. When the upper portion 64 and the extension portion 66 are assembled together, a lower edge 78 of the upper portion 64 overlaps the clearance region 76 of the extension portion 66. The overlap is facilitated by the extension portion 66 being slightly wider than the upper portion 64, such that the outermost ridges 80 of the extension portion 66 out-lie the outermost ridges 56 of the upper portion 64. The overlap between the portions 64, 66 guards against the ingress of precipitation.

To assemble the roof structure 10, the rafters 20 are firstly arranged in place, extending in a ridge-to-eave direction, and the fascia board 24 is attached to a lowermost end of the rafters 20. The roof underlay is laid on top of and fixed to the rafters 20. An opening of the required dimensions is cut in the underlay to provide the roof aperture 18. The frame is arranged around the aperture 18, and the rooflight is then aligned with the aperture 18 and fixed to the rooflight-supporting rafters 20 by brackets.

Next, the drainage panel 26 is lowered into place over the rooflight such that the frame 54 of the drainage panel 26 surrounds the frame of the rooflight. The drainage panel 26 is placed above the rafters 20 and the roof underlay, and is arranged such that the drainage panel 26 extends down the roof structure to the eave 16. The frame 54 is sealed to the rooflight, for example by means of a cover flashing, and the drainage panel 26 is fixed to the supplementary rafters 32.

The battens 22 are then fixed in place on top of the rafters 20, the underlay and the drainage panel 26. Away from the drainage panel 26, the battens 22 are fixed directly to the rafters 20. Immediately before the drainage panel 26, the battens 22 are fixed to the supplementary rafters 32. The battens 22 extend from the supplementary rafters 32 across the drainage panel 26 and may be truncated at the roof aperture 18, or may extend across upper or lower portions of the drainage panel 26.

Once the battens 22 are arranged in place, the tiles 12 are cut to size so as to fit around the rooflight, and are fixed to the battens 22. Finally, any required roof trimmings are added, and the roof structure 10 is then fully assembled.

The sheet 44 of the drainage panel 26, or of the extension portion 66 may be made from any suitable rigid or semi-rigid material including plastics, glass-reinforced plastic (GRP), or metals such as aluminium. The drainage panel 26, ridges 46 and frame 54 may be integral and formed from a unitary piece, for example by injection moulding. However, this need not be the case, and any of the components of the drainage panel may be formed separately and attached to the base by any suitable means.

The roof aperture need not accommodate a rooflight but may accommodate any roof component, for example, a vent, sun pipe, fire escape, chimney, or any component that requires an aperture between the spaces above and below the roof structure. The roof aperture need not be rectangular, but may be any shape so as to accommodate the roof component.

It will be appreciated that many variations and modifications not explicitly described above are also possible without departing from the scope of the invention as set forth in the appended claims.

The invention claimed is:

1. A pitched roof structure including roof rafters, tile-supporting battens extending transversely to, and fixed to, the rafters, a plurality of roof tiles supported by the tile-supporting battens, and a roof aperture in the roof tiles, the roof aperture accommodating a roof component, characterised in that the pitched roof structure includes a drainage panel extending under the roof tiles from the roof aperture to an eave of the roof, the drainage panel being disposed between the roof rafters and tile-supporting battens extending such that precipitation leaking from the vicinity of the roof aperture is directed away from the aperture and under the roof tiles to the roof eave by the drainage panel.

2. The pitched roof structure of claim 1, characterised in that the drainage panel has an upper face provided with at least one run-off channel for directing the leaking precipitation from the roof aperture to the eave.

3. The pitched roof structure of claim 2, characterised in that the at least one run-off channel is defined by parallel ridges projecting from the upper face of the drainage panel.

4. The pitched roof structure of claim 3, characterised in that the ridges raise the battens above the upper face of the drainage panel.

5. The pitched roof structure of claim 3, characterised in that further ridges are disposed at an angle to the parallel ridges and project from the drainage panel above the aperture to deflect leaking precipitation away from the aperture and into the run-off channels.

6. The pitched roof structure of Claim 1, characterised in that the drainage panel has a lower end portion at the eave, and in that the roof structure comprises an eave fascia board having a recess that receives the lower end portion of the drainage panel.

7. The pitched roof structure of Claim 1, characterised in that the drainage panel has a drainage panel portion adjacent the roof aperture and at least one extension portion incorporating a lower end portion of the drainage panel.

8. The pitched roof structure of Claim 1, characterised in that the drainage panel is of unitary construction and made of a metal or of a plastics material.

* * * * *